US008220980B2

(12) United States Patent
Gingrich, III

(10) Patent No.: US 8,220,980 B2
(45) Date of Patent: Jul. 17, 2012

(54) SOCKET ASSEMBLY FOR LIGHT-EMITTING DEVICES

(75) Inventor: Charles Raymond Gingrich, III, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 837 days.

(21) Appl. No.: 12/235,793

(22) Filed: Sep. 23, 2008

(65) Prior Publication Data

US 2010/0073929 A1 Mar. 25, 2010

(51) Int. Cl.
*F21V 7/04* (2006.01)

(52) U.S. Cl. ..... 362/612; 362/611; 362/613; 362/632; 362/633; 362/634

(58) Field of Classification Search ..... 361/640–659
See application file for complete search history.

(56) References Cited

U.S. PATENT DOCUMENTS

| | | | | |
|---|---|---|---|---|
| 6,641,284 | B2 | 11/2003 | Stopa et al. | |
| 6,796,680 | B1 | 9/2004 | Showers et al. | |
| 6,882,111 | B2 | 4/2005 | Kan et al. | |
| 6,936,855 | B1 | 8/2005 | Harrah | |
| 7,128,442 | B2 | 10/2006 | Lee et al. | |
| 7,159,997 | B2 | 1/2007 | Reo et al. | |
| 7,161,190 | B2 | 1/2007 | Chikugawa | |
| 7,207,693 | B2 | 4/2007 | Ratcliffe | |
| 7,221,044 | B2 | 5/2007 | Fan et al. | |
| 7,273,987 | B2 | 9/2007 | Becker et al. | |
| 7,285,802 | B2 | 10/2007 | Ouderkirk et al. | |
| 7,311,420 | B2 | 12/2007 | Tan et al. | |
| 7,407,307 | B2 | 8/2008 | Hiratsuka | |
| 7,703,941 | B2 * | 4/2010 | Lee | 362/219 |
| 2003/0103347 | A1 * | 6/2003 | Friend | 362/225 |
| 2003/0179548 | A1 | 9/2003 | Becker et al. | |
| 2005/0007033 | A1 | 1/2005 | Kan et al. | |
| 2005/0024864 | A1 | 2/2005 | Galli | |
| 2006/0131596 | A1 | 6/2006 | Ouderkirk et al. | |
| 2008/0087911 | A1 * | 4/2008 | Stoyan | 257/99 |
| 2008/0128739 | A1 | 6/2008 | Sanpei et al. | |

FOREIGN PATENT DOCUMENTS

| | | |
|---|---|---|
| EP | 1 901 406 | 3/2008 |

OTHER PUBLICATIONS

International Search Report, International Application No. PCT/US2009/005257, International Filing Date Sep. 22, 2009.

* cited by examiner

*Primary Examiner* — William Carter

(57) ABSTRACT

An assembly for light-emitting devices has a base, at least one light-emitting device, and a cover. The at least one light-emitting device is positioned in recess on the base and is received in a light-emitting device receiving opening on the cover. Latches are provided on the cover and extend into cover mounting openings of the base to latch the cover to the base. The base has a first contact strip and a second contact strip. The first contact strip and the second contact strip have contact ends which extend beyond first and second ends of the base. The contact ends of one assembly may engage the contact ends of a second assembly to provide the assemblies in electrical engagement.

18 Claims, 6 Drawing Sheets

SOCKET ASSEMBLY FOR LIGHT-EMITTING DEVICES

FIELD OF THE INVENTION

The present invention relates to the field of lighting systems and in particular to a strip lighting system incorporating light-emitting devices.

BACKGROUND OF THE INVENTION

In many applications fluorescent, neon and incandescent lighting systems are used. However, these systems can have various disadvantages which include: short and/or inconsistent life of the light element, high voltage requirements, significant weight, heat generation and fragility of the lighting element or bulb.

One solution that has been used to counter the problems identified above has been to use a light-emitting diode (LED), either singularly or in groups. As an example, U.S. Pat. No. 6,158,882 discloses an LED semiconductor lighting system that comprises a lighting apparatus for illuminating vehicle interiors and powered by a source of electrical power provided by or on the vehicle. The lighting apparatus comprises a light tube with an interior space and has a plurality of light-emitting diodes and current limiting resistors contained within such interior space of the light tube.

U.S. Pat. No. 6,371,637 discloses a flexible, high density, low profile lighting system which includes a flexible printed circuit board substrate which is adapted to support and electrically interconnect surface mount electronic components. A plurality of surface mount light-emitting diodes are mounted on the substrate so as to define a conformably bendable lighting array configured for mounting upon surfaces with compound curvature.

U.S. Pat. No. 6,472,823 discloses an LED tubular lighting device which includes LEDs planted in a transparent tube. The tubular lighting device includes LEDs soldered onto a circuit board in an equi-distant arrangement. The circuit board with the LEDs is secured in a boat-shaped receiving, heat-dissipating trough, which are disposed in a transparent tube having heat-dissipating holes in the bottom wall thereof and through holes in both ends thereof.

U.S. Pat. No. 6,882,111 discloses an elongated lighting apparatus that can withstand temperature fluctuations. The elongated lighting apparatus has at least two elongated tubular members fabricated from translucent material. These elongated tubular members are fixed in an end-to-end configuration, separated by a region enabling for thermal expansion/contraction of the members. A substrate upon which a plurality of light-emitting devices is placed, is slidably positioned inside each tubular member. End caps seal the open ends of the elongated tubular members. The light-emitting devices are electrically interconnected. An external power source provides a system to energize the light sources.

While all of these devices disclose strip lighting systems which incorporate LEDs, these devices are tedious and expensive to manufacture. Each of the devices described teaches of the LEDs mounted on a printed circuit board utilizing conductive adhesives or soldering. The requirement of a printed circuit board is expensive, and the use of conductive adhesive or soldering to mount the LED to the printed circuit board is a time consuming and exacting process. It would therefore be beneficial to provide an LED strip lighting system which did not required the use of a printed circuit board and which do not require the LEDs to be mounted using conductive adhesives or soldering.

SUMMARY OF THE INVENTION

In accordance with an aspect of the invention, an assembly for light-emitting devices is provided. The assembly has a base, at least one light-emitting device, and a cover. The base has at least one recess and cover mounting openings. The at least one light-emitting device is provided in the at least one recess. The cover has at least one light-emitting device receiving opening which has a shoulder which cooperates with the at least one light-emitting device to maintain the at least one light-emitting device in the at least one recess. Latches extend form the cover into the cover mounting openings to latch the cover to the base.

In accordance with another aspect of the invention, the base of the assembly has a first contact strip and a second contact strip which extend along a first surface of the base. The first contact strip carries a positive electrical current and the second contact strip carries a negative electrical current. The at least one light-emitting device is provided on the first surface of the base. The cover has contacts which electrically engage contact pads on the at least one light-emitting device. Bridge contacts extend between the contacts and the first contact strip and the second contact strip to place the contacts in electrical engagement with the first contact strip and the second contact strip, such that the contact pads of the at least one light-emitting device are placed in electrical engagement with the contacts of the cover and the first and second contact strips.

In accordance with another aspect of the invention, the base has at least one recess provided thereon and cover mounting openings. The at least one light-emitting device is positioned in the at least one recess. The cover has at least one light-emitting device receiving opening for receiving the at least one light-emitting device. Latches are provided on the cover and extend into the cover mounting openings to latch the cover to the base. The base has a first contact strip and a second contact strip. The first contact strip and the second contact strip have contact ends which extend beyond first and second ends of the base. The contact ends have bent portions which extend in a direction parallel to the respective first and second ends of the base, whereby the bent portions of one assembly may engage the bent portions of a second assembly to provide the assemblies in electrical engagement.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
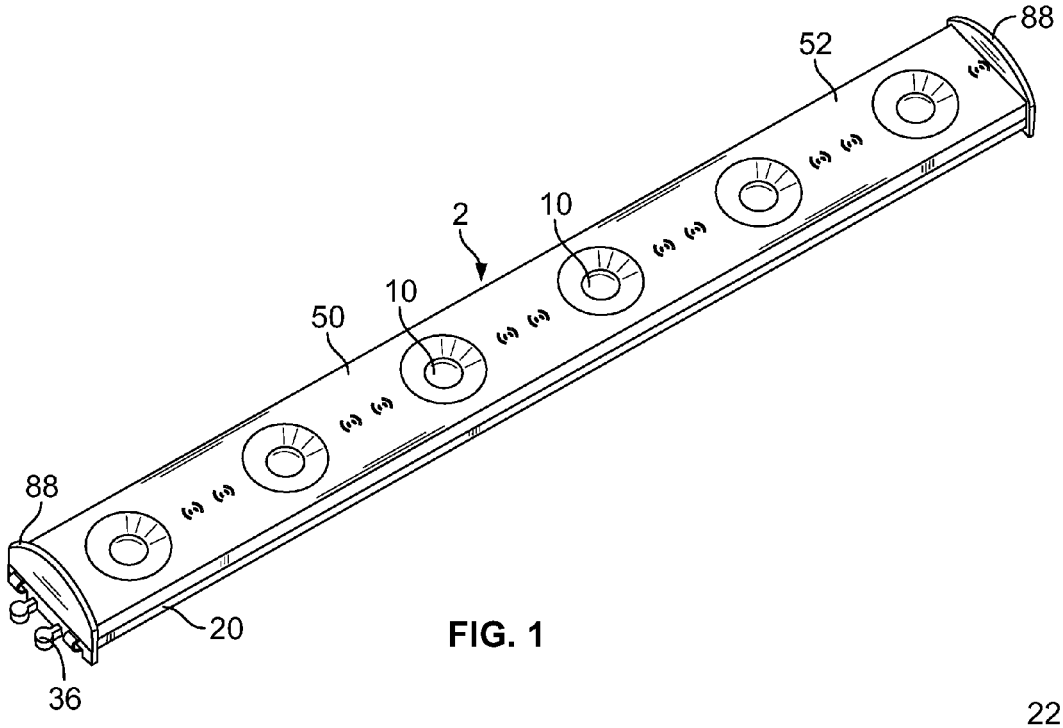
FIG. 1 is a perspective view of an LED linear assembly according to one embodiment.
Figure 2:
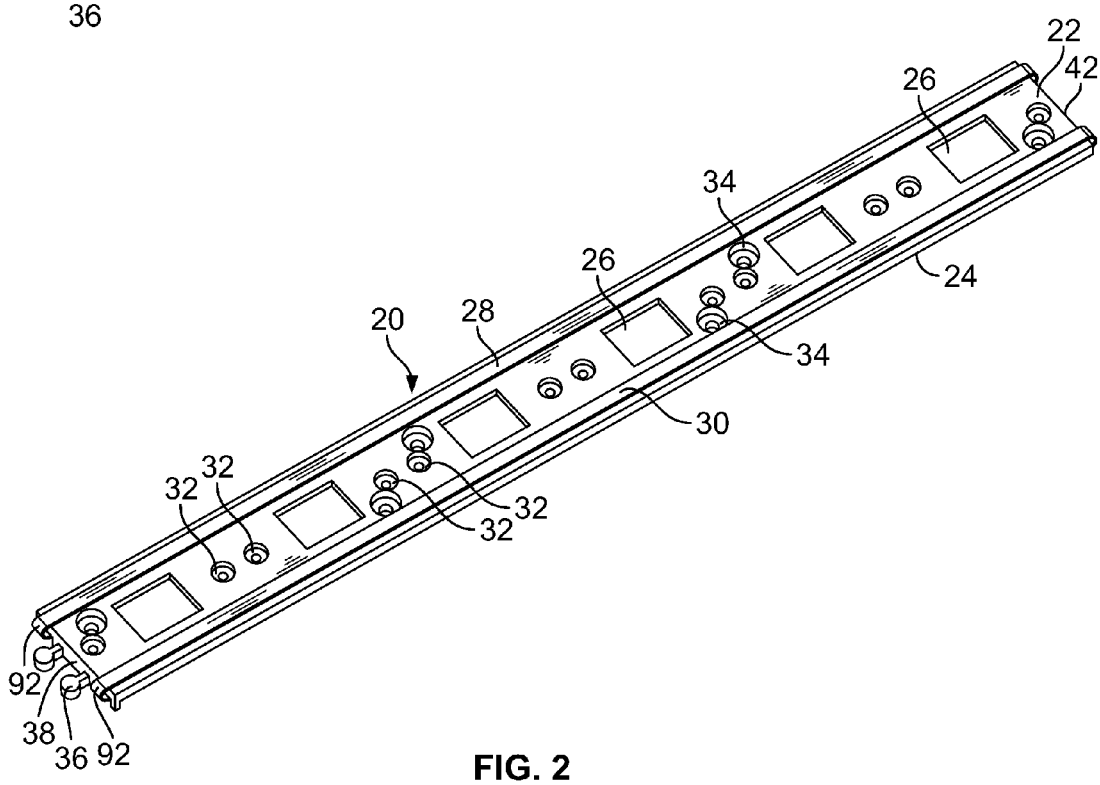
FIG. 2 is a top perspective view of a thermally conductive base of the LED linear assembly of FIG. 1.

Referring to FIG. 1 and FIG. 2, an LED linear module assembly 2 is shown. As best shown in FIG. 2, the assembly 2 has a base 20 which is made from a thermally conductive polymer or other suitable material which has the strength and thermally conductive characteristics required. The base 20 has a first surface 22 and an oppositely facing second surface 24. LED receiving recesses 26 are positioned along the first surface 22. In the embodiment shown, six such LED receiving recesses 26 are shown and are spaced equidistant along the longitudinal axis of the base 20. The embodiment shown is configured such that the lumen output from light-emitting devices, including LEDs 10, housed in the LED receiving recesses 26 will approximate the lumen output of a T5 fluorescent bulb. However, the invention is not limited to the use of six LEDs or six light emitting devices or to the output described. Any number of LED receiving recesses 26 can be provided in the base 20 to accommodate the appropriate number of light-emitting devices required.

Extending along the length of the first side of the base 20 are contact strips 28, 30. In the embodiment shown, contact strip 28 acts as a positive strip and contact strip 30 acts as a negative strip. A plurality of cover receiving openings 32 are positioned along the base 20 and extend from the first surface 22 through the second surface 24. In the embodiment shown, the cover receiving openings 32 are positioned along the longitudinal axis of the base 20; however, other configurations and alternate positioning of the cover receiving openings 32 can be incorporated. Mounting openings 34 are also provided at various positions along the base 20. The mounting openings 34 extend from the first surface 22 through the second surface 24 and allow for hardware or the like to extend therethrough to mount the base 20 to a heat sink (not shown) or other similar device.

Keying projections 36 extend from a first end 38 of the base 20. Keying openings 40 (FIG. 10) are provided in the second surface 24 of base 20 proximate a second end 42. Keying projections 36 of a first assembly 2 engage with keying openings 40 of a second assembly 2 to secure the first and second assemblies in position relative to each other, as will be more fully described.

In the embodiment shown, the base is made of a single thermally conductive polymer as previously described. In the alternative, the base could be made of a standard rigid insulating (both thermally and electrically) base component with elastomeric thermally conductive pads integrally molded therein. The thermally conductive pads would extend from the LED receiving recesses 26 to the second surface 24 of the base 20, thereby providing a thermally conductive pathway, as will be more fully discussed.

Figure 3:
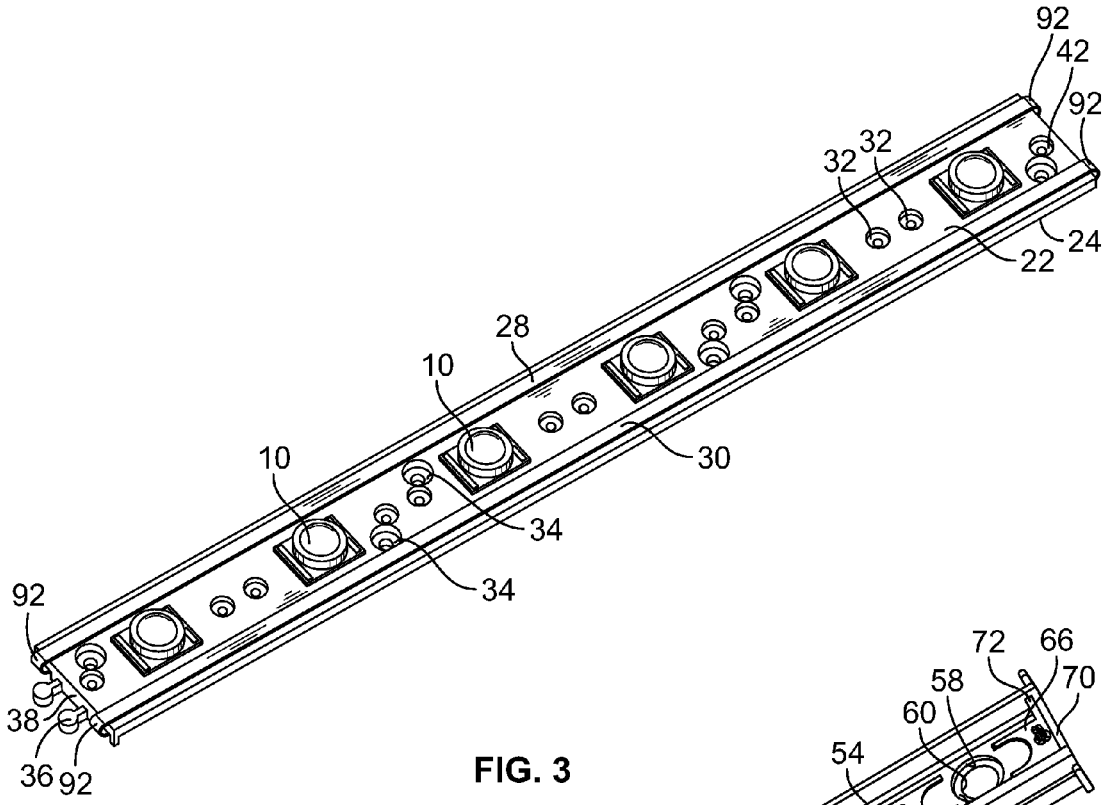
FIG. 3 is a top perspective view of the thermally conductive base of the LED linear assembly, as shown in FIG. 2, with LEDs positioned thereon.

Referring to FIG. 3, the LEDs 10 are positioned in the LED receiving recesses 26. A thermal interface material (not shown) may be applied in the LED receiving recesses 26 prior to the positioning of the LEDs 10 therein. The thermal interface material may be a thermal grease or may be a compliant thermal pad or any other substance which has the appropriate heat transfer characteristics. For ease of explanation and understanding, the thermal interface material used in this embodiment is a thermal grease. The thermal grease is engaged by the bottom surfaces of the LEDs 10, allowing the thermal grease to fill in any voids or irregularities in the bottom surfaces of the LEDs 10. In addition, the positioning of the LEDs 10 causes the grease to flow and fill any voids on the surfaces of the LED receiving recesses 26. The use of the thermal grease enhances the thermal coupling between the LEDs 10 and the base 20 to allow the base 20 to better draw heat away from the LEDs 10.

In applications in which the thermal grease is used, the thermal grease can provide a minimal temporary adhesion of the LEDs 10 to the base 20. This can help maintain the LEDs 10 in the LED receiving recesses 26 until a cover 50 is inserted to more rigidly maintain the LEDs 10 in the LED receiving recesses 26, as will be more fully discussed below.

Figure 4:
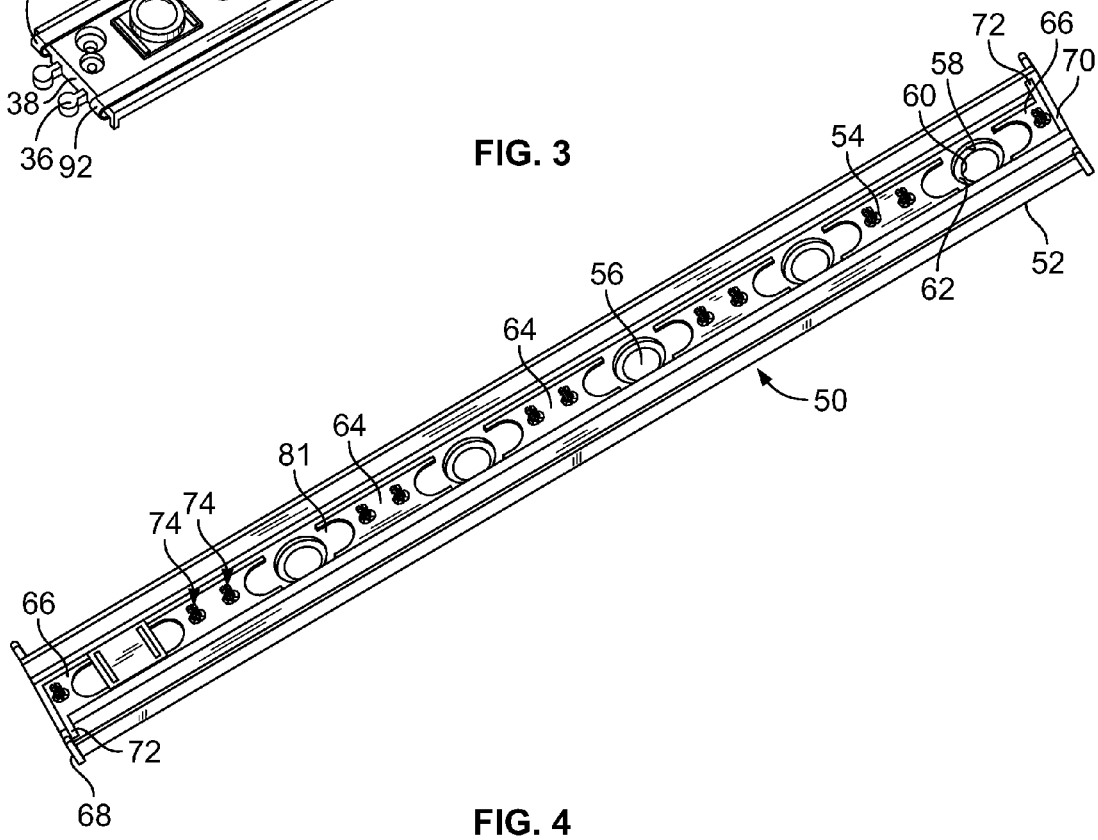
FIG. 4 is a bottom perspective view of a top cover of the LED linear assembly of FIG. 1.

Referring to FIG. 4, the cover 50 has a first surface 52 and a second surface 54. LED receiving openings 56 are positioned to align with the LED receiving recesses 26 of base 20. The LED receiving openings 56 extend through the cover 50 and have a larger diameter portion 58 proximate the second surface 54 and a smaller diameter portion 60 proximate the first surface 52. A shoulder 62 transitions between portions 58, 60.

Figure 5:
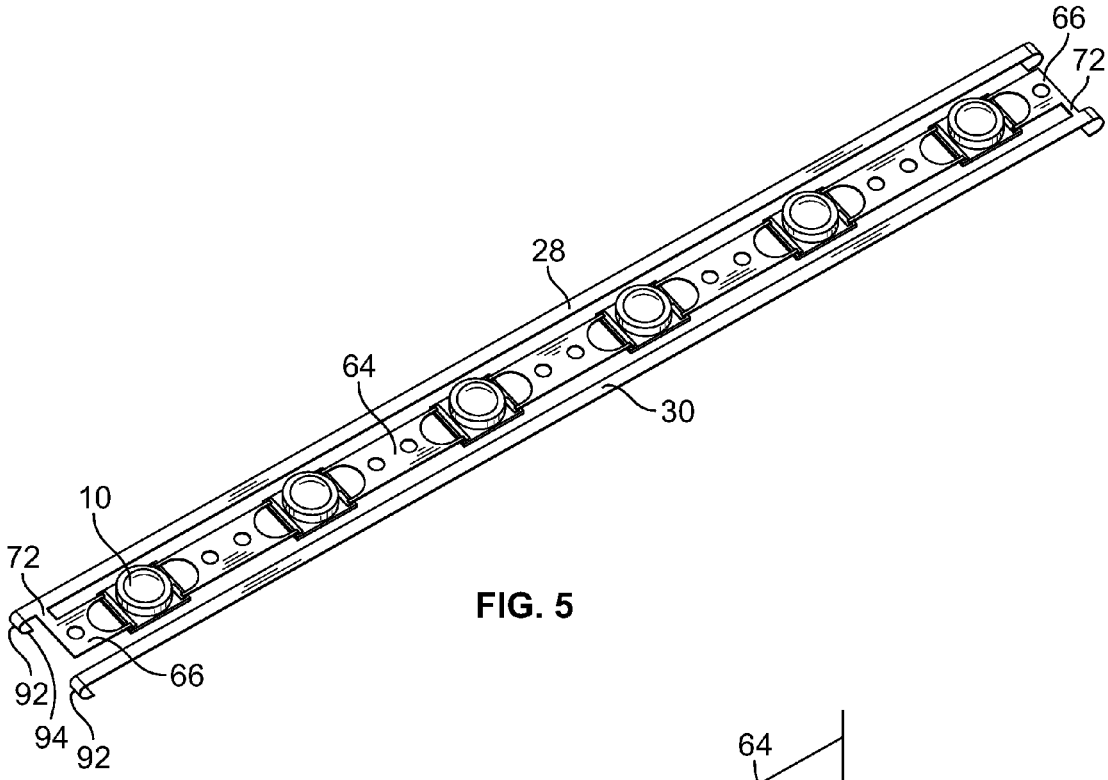
FIG. 5 is a perspective view of the contact structure of the LED linear assembly of FIG. 3.
Figure 6:
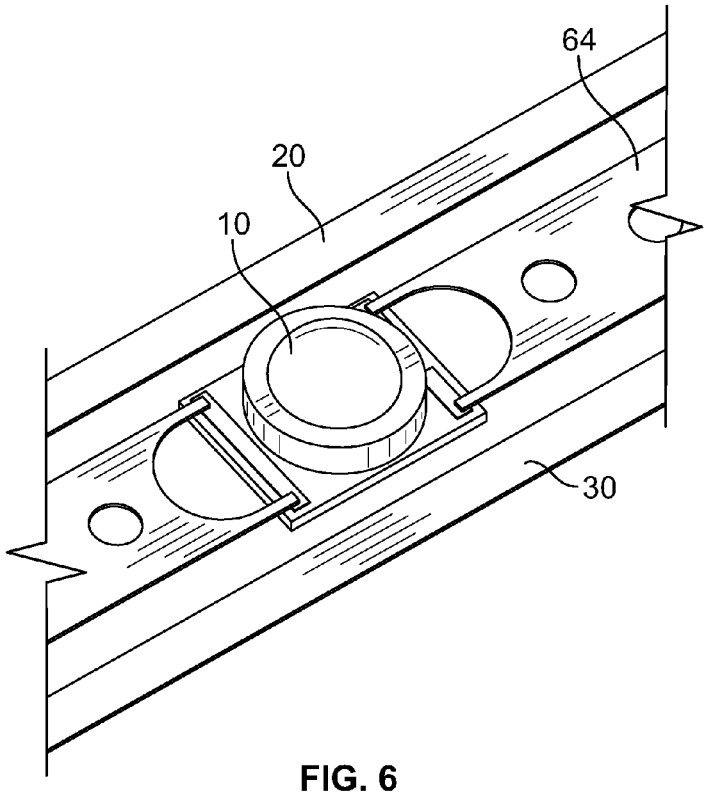
FIG. 6 is an enlarged perspective view of one respective LED in relation to the contact structure of FIG. 5.

Referring to FIGS. 4 through 6, contacts 64 extend between LED receiving openings 56. End contacts 66 extend from respective LED receiving openings 56 toward a first end 68 and a second end 70 respectively. Each end contact 66 has a bridge portion 72. As best shown in FIG. 5, the contacts 64 and end contacts 66 extend in a line along the longitudinal axis of the cover 50.

Figure 7:
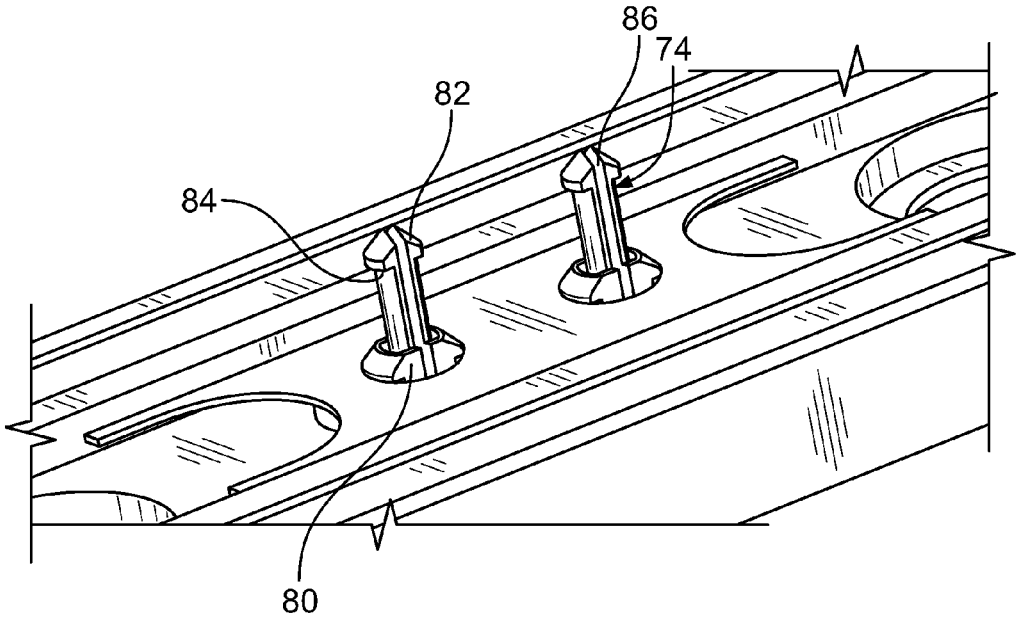
FIG. 7 is an enlarged perspective view of respective latching members of the top cover of FIG. 4.
Figure 8:
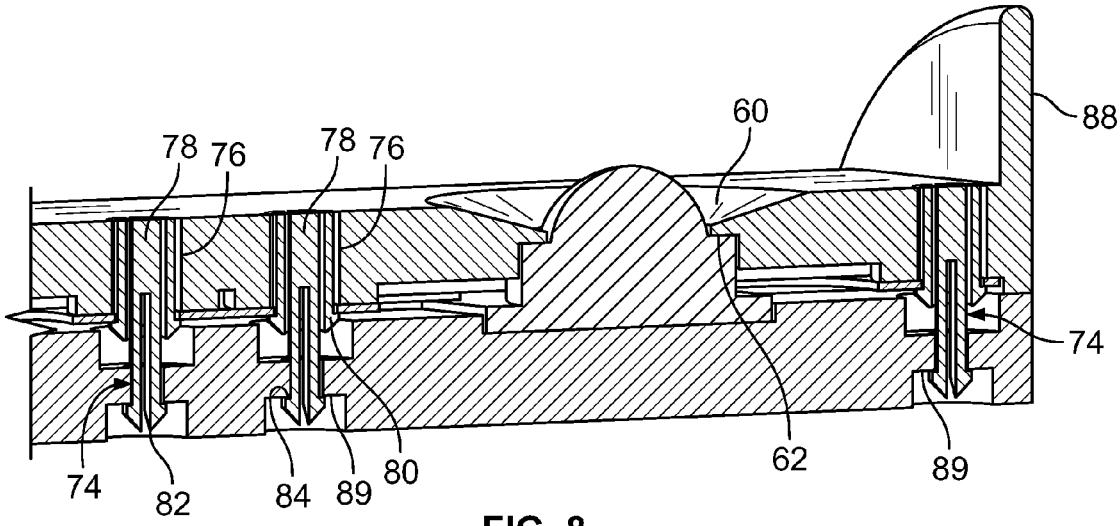
FIG. 8 is a cross-sectional vies of the LED linear assembly of FIG. 1 showing the latching members.

As best shown in FIGS. 4, 7 and 8, latches 74 engage latch openings 76 of cover 50. Base portions 78 are inserted through openings in the contacts 64 and end contacts 66 into the latch openings 76 of cover 50. The base portions 78 are dimensioned to be maintained in the latch openings 76 by frictional engagement with the walls of the latch openings 76. When fully inserted, shoulders 80 of the latches 74 engage the contacts 64 and end contacts 66 to maintain them in position relative to the cover 50. The contacts 64 and end contacts 66 are also mounted in a plate receiving recess 81 of cover 50 to provide increased stability to the contacts 64 and end contacts 66.

Latches 74 also have free ends 82 which extend from the base portions 78. The free ends 82 have latching shoulders 84 which cooperate with the base 20 to mount the cover 50 to the base 20. The free ends 82 have slits 86 which extend therethrough to allow the free ends 82 to resiliently deform inward upon engaging the cover receiving openings 32 of the base.

When the cover 50 is assembled to the base 20, as shown in FIG. 8, the free ends 82 of the latches 74 are moved into cover receiving openings 32. In this fully assembled position, the latching shoulders 84 and shoulders 89 of cover receiving openings 32 cooperate to maintain the cover 50 in position on the base 20. In this position, the shoulders 62 of the LED receiving openings 56 also cooperate with the LEDs 10 to retain the LEDs 10 in position.

With the cover 50 mounted on the base 20, the cover 50 engages the LEDs 10 and forces the LEDs 10 toward the base 20. This facilitates the thermal bond between the LEDs 10 and the base 20, allowing the base 20 to draw heat away from the LEDs 10.

The assembly 2 may be mounted to a heat sink in applications where heat dissipation is important. Screws (not shown)

or other mounting members would extend through the mounting openings 34 and into the heat sink.

In an alternate embodiment of base 20, the base may be molded from two materials. The majority of the base would be molded using standard rigid polymer to provide the strength requirements. A second material, an elastomeric thermally conductive polymer, can be molded into the base 20 at the LED receiving recesses 26 and extend to the second surface 24. This allows the LEDs 10 to be positioned on the elastomeric thermally conductive polymer, thereby allowing heat to be drawn from the LEDs 10. The use of an elastomeric, thermally conductive polymer material allows the material to better conform to the bottom surface of the LEDs 10, thereby eliminating the need for additional thermal interface material.

With the cover 50 and base 20 properly secured, the LEDs 10 are provided in electrical engagement with the contacts 64 and end contacts 66. Referring again to FIGS. 5 and 6, the contact structure of the assembled base 20 and over 50 is shown with the LEDs 10. In these FIGS., the polymer material has not been shown to better facilitate an understanding of how the electrical contact is made. The positive contact strip 28 is in electrical engagement with the bridge portion 72 of the end contact 66 provided proximate the first end 68 (FIG. 4) of cover 50. The negative contact strip 30 is in electrical engagement with the bridge portion 72 of the end contact 66 provided proximate the second end 70 (FIG. 4) of the cover 50. The contacts 64 extend between the LED's 10 and make electrical engagement with contact pads on the LEDs 10. Consequently, the electrical current flows from the positive contact strip 28 across the first end contact 66, across the contacts 64 and LEDs 10, across the second end contact 66 to the negative contact strip 30, placing the LEDs in series electrically. As the cover exerts a force on the LEDs 10 when fully assembled, the electrical connection between the strips 28, 30 and the bridge portions 72 and the electrical connection between the contacts 64, 66 and the contact pads of the LEDs 10 are ensured.

Referring to FIG. 2, the contact strips 28, 30 extend beyond the first end 38 and the second end 42 of base 20. The contact strips 28, 30 have bent portions 92 (FIG. 5) which extend to free ends 94. The free ends 94 are provided in receiving recess 95 (FIG. 6) on the second surface 24 of the base 20, such that the free ends 94 are movable in a direction parallel to the longitudinal axis of the base 20.

Figure 11:
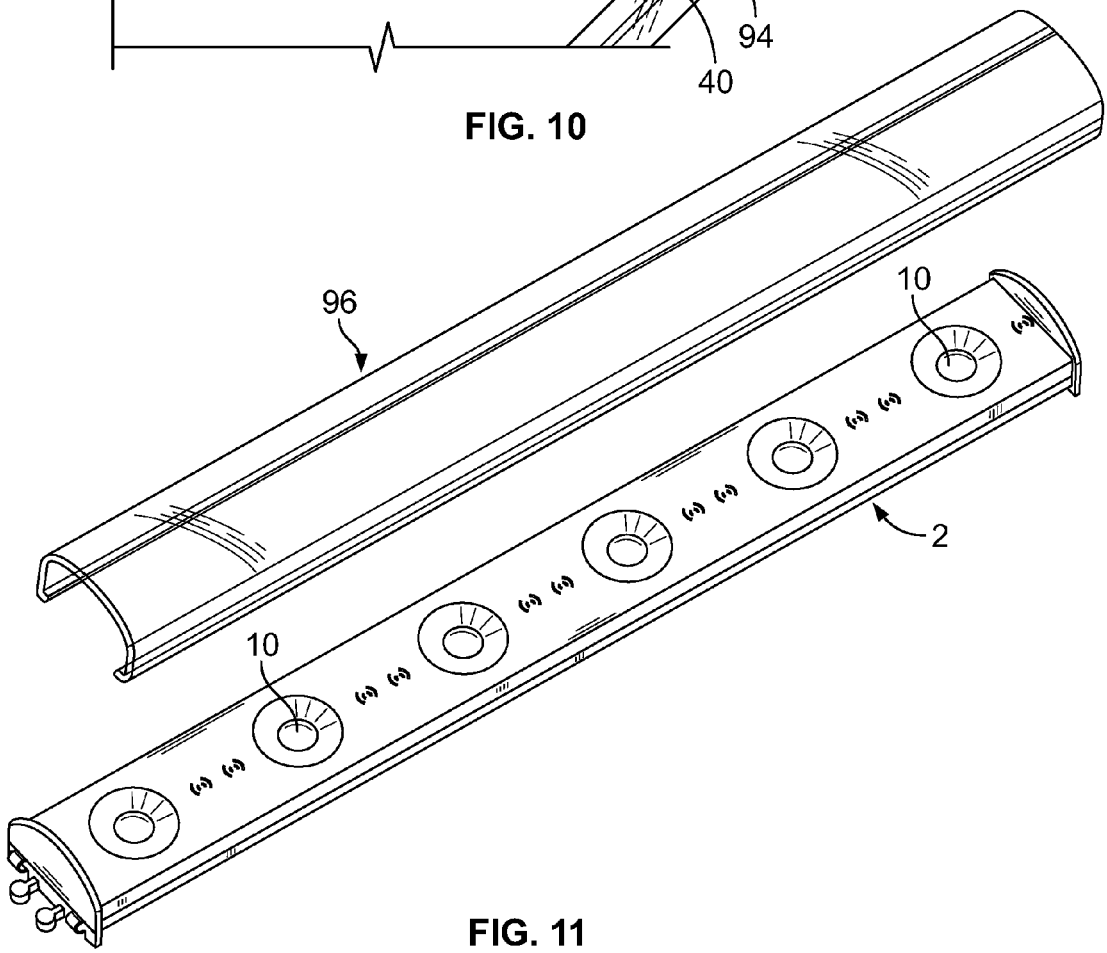
FIG. 11 is a perspective view of the LED linear assembly of FIG. 1 with a diffuser exploded therefrom.

As best shown in FIGS. 1 and 11, end walls 88 are provided at first end 68 and second end 70. The end walls extend from the first surface 52 in a direction away from second surface 54. The end walls 88 have arcuate free ends which match the profile of a diffuser 96.

With the cover 50 and the base 20 assembled, the diffuser 96 may be moved into position on the cover 50. The diffuser 96 may be snapped into position or mounted in any known manner. The diffuser 96 diffuses the light generated by the LEDs 10.

Figure 9:
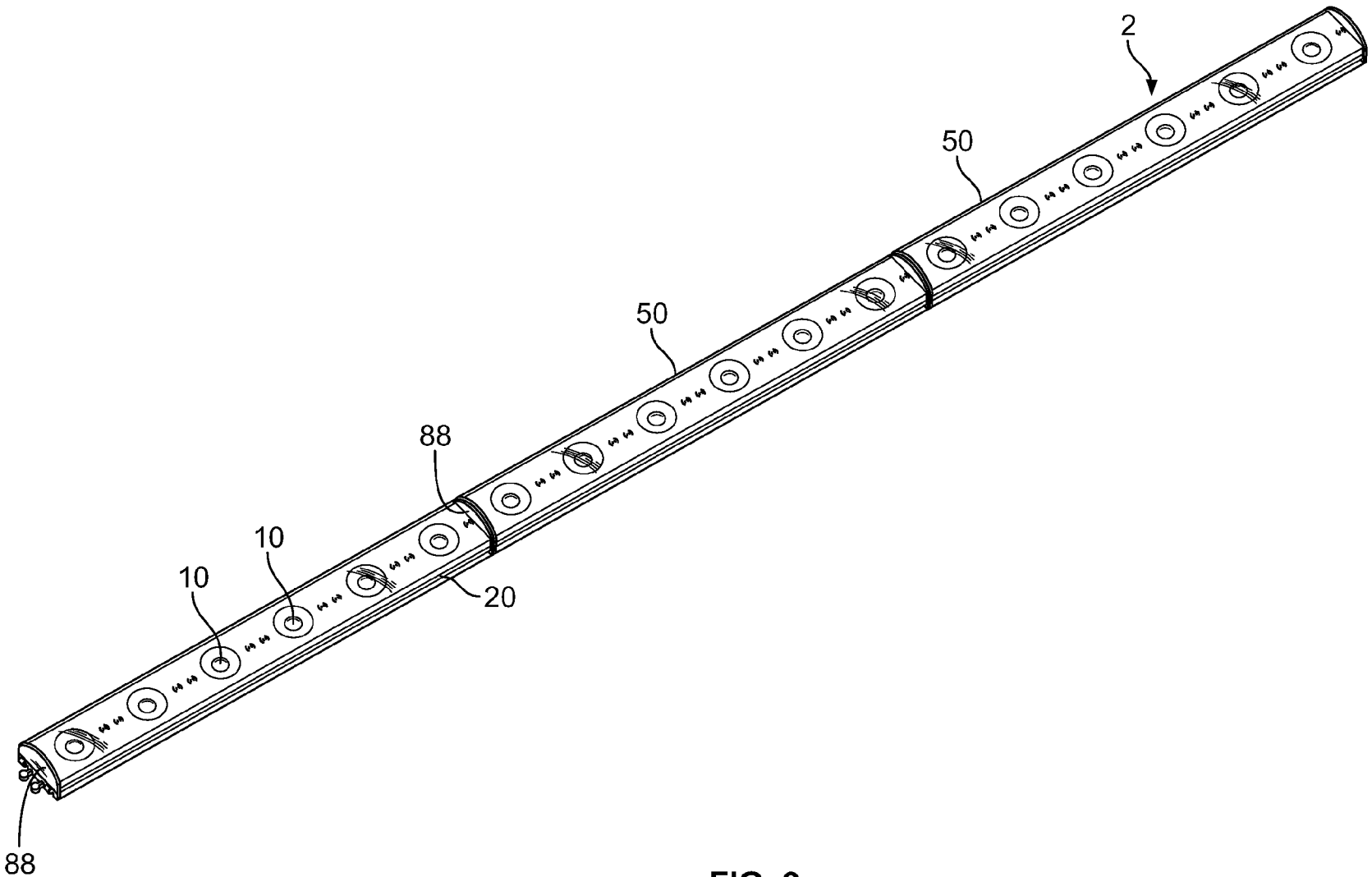
FIG. 9 is a perspective view of several LED linear assembly joined together to form a linear.
Figure 10:
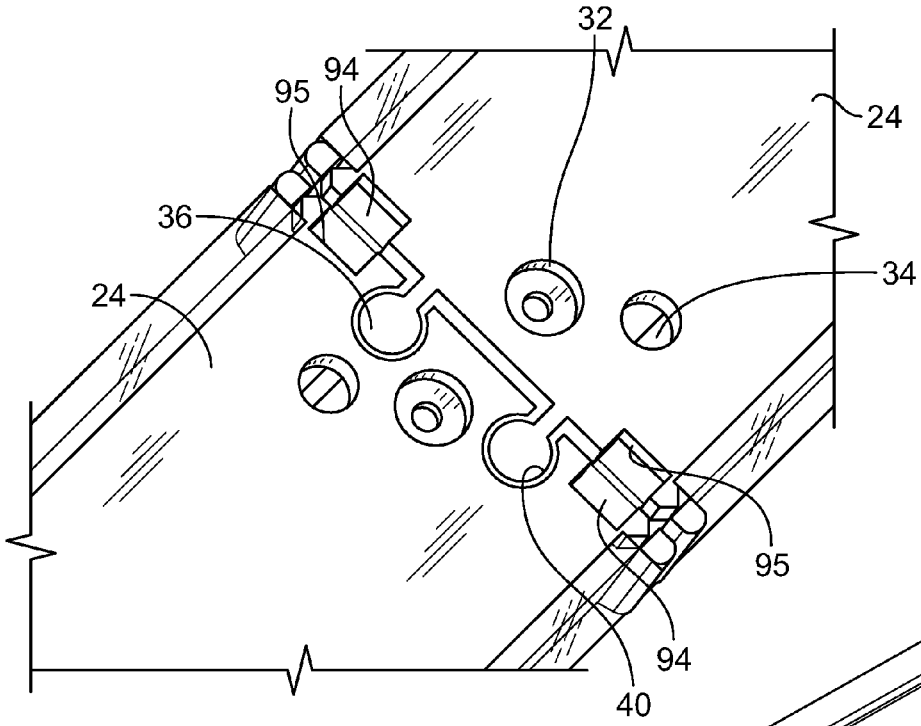
FIG. 10 is an enlarged perspective view of respective latching members of FIG. 9.

Referring to FIGS. 9 and 10, each assembly 2 may be joined to other assemblies to form a linear array of the assemblies. The keying projections 36 of a first assembly are placed in the keying openings 40 of a second assembly and are snapped in place. As this occurs, the bent portions 92 of the contact strips 28, 30 of the first assembly physically engage the free ends of the contact strips 28, 30 of the second assembly. As the bent portions 92 are bent ends of the contact strips 28, 30, they have resilient characteristics in the longitudinal direction of the base 20. Consequently, as the bent portions 92 of the first assembly and the second assembly engage, the bent portions 92 of each assembly are resiliently deformed inward toward their respective bases 20. This allows the bent portions 92 to compensate for any tolerance variations in the bases 20 or environmental changes which may cause slight dimensional variations in the bases 20 or contact strips 28, 30, thereby placing the contact strips of the first and second assemblies in reliable electrical engagement. More assemblies 2 can be added in a similar manner. A power source can be connected to the contact strips to electrify the entire linear array. The connection to the power source can be made in a manner similar to that described above or in any other known manner.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An assembly for light-emitting devices, the assembly comprising;

a base having at least one recess provided thereon and cover mounting openings, the base having first contacts provided thereon;

at least one light-emitting device provided in the at least one recess;

a cover having a light-emitting device receiving opening, the light-emitting device receiving opening having a shoulder which cooperates with the light-emitting device to maintain the light-emitting device in the at least one recess, the cover having second contacts provided thereon which extend into the light-emitting device receiving opening; and the cover having latches which extend into the cover mounting openings to latch the cover to the base, the latches engage the second contacts to maintain the second contacts in position relative to the cover, such that the at least one light-emitting device is maintained in electrical engagement with the second contacts and the second contacts are maintained in electrical engagement with the first contacts without the use of solder.

2. The assembly as recited in claim 1 wherein the base is a thermally conductive material to draw heat away from the light-emitting device.

3. The assembly as recited in claim 1 wherein base is a rigid material with an elastomeric thermally conductive material provided at the at least one recess to draw heat away from the at least one light-emitting device.

4. The assembly as recited in claim 1 wherein a keying projection extends from a first end of the base.

5. The assembly as recited in claim 4 wherein a keying opening extends from a second opposite end of the base, wherein the keying projection of a first assembly can be inserted into the keying opening of a second assembly to form an array of assemblies.

6. The assembly as recited in claim 1 wherein a first contact strip and a second contact strip extend along a first surface of the base, the first contact strip carrying a positive electrical current and the second contact strip carrying a negative electrical current.

7. The assembly as recited in claim 6 wherein contacts are provided in the cover, the contacts electrically engage contact pads on the light-emitting device, bridge contacts extend between the contacts and the first contact strip and the second contact strip to place the contacts in electrical engagement with the first contact strip and the second contact strip.

8. The assembly as recited in claim 7 wherein the first contact strip and the second contact strip have contact ends which extend beyond first and second ends of the base, the contact ends have bent portions which extend in a direction parallel to the respective first and second ends of the base, whereby bent portions of one assembly may engage bent portions of a second assembly to provide the assemblies in electrical engagement.

9. An assembly for light-emitting devices, the assembly comprising;

a base having a first contact strip and a second contact strip extending along a first surface of the base, the first contact strip carrying a positive electrical current and the second contact strip carrying a negative electrical current;

a light-emitting device provided on the first surface of the base, the at least one light-emitting device having contact pads provided thereon;

a cover having contacts, the contacts electrically engaging the contact pads on the at least one light-emitting device, bridge contacts extending between the contacts and the first contact strip and the second contact strip to place the contacts in electrical engagement with the first contact strip and the second contact strip, latches provided on the cover, the latches extend through the contacts and cooperate with the contacts to maintain the contacts in position on the cover;

wherein the contact pads of the light-emitting device are placed in electrical engagement with the contacts of the cover and the first contact strip and the second contact strip of the base and are maintained in electrical engagement by the cooperation of the latches with openings provided in the base.

10. The assembly as recited in claim 9 wherein the first contact strip and the second contact strip have contact ends which extend beyond first and second ends of the base, the contact ends have bent portions which extend in a direction parallel to the respective first and second ends of the base, whereby bent portions of one assembly may engage bent portions of a second assembly to provide the assemblies in electrical engagement.

11. The assembly as recited in claim 9 wherein base is a thermally conductive material to draw heat away from the light-emitting device.

12. The assembly as recited in claim 9 wherein base is a rigid material with an elastomeric thermally conductive material provided proximate a recess in which the at least one light-emitting device is positioned to draw heat away from the light-emitting device.

13. The assembly as recited in claim 9 wherein the cover has latches which extend into cover mounting openings in the base to latch the cover to the base.

14. An assembly for light-emitting devices, the assembly comprising;

a base having a recess provided thereon and cover mounting openings;

a light-emitting device provided in the recess;

a cover having a light-emitting device receiving opening for receiving the light-emitting device, the cover having latches which extend into the cover mounting openings to latch the cover to the base, the latches extend through contacts provided in the cover and cooperate with the contacts to maintain the contacts in position on the cover;

the base having a first contact strip and a second contact strip, the first contact strip and the second contact strip having contact ends which extend beyond first and second ends of the base, the contact ends have bent portions which extend in a direction parallel to the respective first and second ends of the base, whereby the bent portions of one assembly may engage the bent portions of a second assembly to electrically engage the assemblies;

wherein the cover has contacts, the contacts electrically engaging contact pads on the light-emitting device, bridge contacts extending between the contacts and the first contact strip and the second contact strip to place the contacts in electrical engagement with the first contact strip and the second contact strip.

15. The assembly as recited in claim 14 wherein the base is a thermally conductive material to draw heat away from the light-emitting device.

16. The assembly as recited in claim 14 wherein the base is a rigid material with an elastomeric thermally conductive material provided proximate the recess in which the light-emitting device is positioned to draw heat away from the light-emitting device.

17. The assembly as recited in claim 14 wherein the cover has latches which extend into cover mounting openings in the base to latch the cover to the base.

18. The assembly as recited in claim 14 wherein a keying projection extends from a first end of the base and a keying opening extends from a second end of the base, wherein the keying projection of one assembly can be inserted into the keying opening of a second assembly to form an array of assemblies.

* * * * *